US007104932B1

(12) United States Patent
Brentlinger

(10) Patent No.: US 7,104,932 B1
(45) Date of Patent: Sep. 12, 2006

(54) EXERCISE DEVICE FOR USE IN SWIMMING POOL

(76) Inventor: Karen W. Brentlinger, 494 Blanton Mill Rd., Williamson, GA (US) 30292

( * ) Notice: Subject to any disclaimer, the term of this patent is extended or adjusted under 35 U.S.C. 154(b) by 326 days.

(21) Appl. No.: 10/666,123

(22) Filed: Sep. 22, 2003

(51) Int. Cl.
*A63B 22/06* (2006.01)

(52) U.S. Cl. ..... 482/57; 482/55; 482/69; 434/254

(58) Field of Classification Search ..... 482/55–57, 482/69, 111, 124, 129; 441/129; 434/254; D21/801, 804, 805; 273/DIG. 19
See application file for complete search history.

(56) References Cited

U.S. PATENT DOCUMENTS

| | | | | |
|---|---|---|---|---|
| 3,426,722 A | | 2/1969 | Dragich | |
| 3,988,020 A | * | 10/1976 | Carter | 482/55 |
| 4,109,905 A | * | 8/1978 | Meier | 482/55 |
| 4,247,096 A | * | 1/1981 | Schmitt | 482/55 |
| 4,289,487 A | | 9/1981 | Fattler | |
| 4,524,711 A | | 6/1985 | Ashrow | |
| 4,544,155 A | | 10/1985 | Wallenbrock et al. | |
| 4,962,923 A | * | 10/1990 | Earner | 482/55 |
| 5,083,522 A | * | 1/1992 | Ashrow | 114/215 |
| 5,236,404 A | * | 8/1993 | MacLennan | 482/55 |
| 5,601,514 A | * | 2/1997 | Horn | 482/55 |
| 5,816,982 A | * | 10/1998 | Croushore | 482/55 |
| 5,820,530 A | * | 10/1998 | Kallassy | 482/111 |
| 5,846,167 A | | 12/1998 | Liu et al. | |
| 6,176,815 B1 | * | 1/2001 | Riera | 482/55 |
| 6,520,893 B1 | * | 2/2003 | Bray | 482/140 |

* cited by examiner

*Primary Examiner*—Stephen K. Cronln
*Assistant Examiner*—Tam Nguyen
(74) *Attorney, Agent, or Firm*—Donald R. Schoonover

(57) ABSTRACT

An exercise device includes a belt unit that has an element that encircles a swimmer's hips near the pelvis. The belt unit includes restraining straps that are attached to the element encircling the swimmer's hips by means of hook-and-loop material so the straps can be located in the most effective position on the swimmer. The device further includes an anchor that can be attached to a stationary device associated with the swimming pool and has rotatable rings that are attached to the restraining straps.

8 Claims, 2 Drawing Sheets

EXERCISE DEVICE FOR USE IN SWIMMING POOL

BACKGROUND OF THE INVENTION

1. Field of the Invention

The present invention relates to the general art of exercise and therapeutic equipment, and to the particular field of swimming accessories.

2. Discussion of the Related Art

Swimming is well recognized for exercise and therapy. People can swim even if they are disabled, elderly, or the like, because swimming provides excellent cardiovascular exercise as well as excellent physical exercise without placing undue stress and strain on muscles, tendons, bones and joints. People can swim well into their 80's and 90's when they cannot participate in most other sports.

While excellent, swimming does have some drawbacks. For example, some people do not have easy or convenient access to a public swimming pool. Others are shy or reluctant to swim in a public pool or in a pool that has many other swimmers. Some pools are not easily accessible to some users.

Therefore, there is a need for a means for permitting a person to swim while overcoming the above-mentioned problems.

The art contains several examples of devices that allow a person to swim in place. That is, some form of resistance is applied to a swimmer so the swimmer can exert energy in swimming while not requiring a great deal of space. A common example of this is the bungee cord tied to a swimmer and anchored to a stationary object associated with the swimming pool. The swimmer swims to the end of the bungee cord and then tries to swim further while the cord stretches and retards the swimmer. The bungee cord, along with nearly all other presently-available devices, includes a belt that is worn around the swimmer's waist. While the presently-available devices solve many of the above-mentioned problems, they have problems of their own.

The most important drawback associated with the presently-known devices is that these designs focus on the effect of holding the swimmer's body stationary in the water and these known devices fail to address the significant forces affecting the body during the act of swimming. Proper alignment is crucial in any sport and, if not addressed, can lead to fatigue, serious injury and/or pain.

Therefore, there is a need for a device that permits swimming in place but which provides proper alignment for the swimmer during swimming.

Furthermore, many of the presently-known devices are not comfortable to wear. Some of the devices have waist bands that place a great deal of force on the swimmer over a small area. This stress may create sores and may improperly align the forces on the swimmer.

Therefore, there is a need for a device that permits swimming in place but which provides proper alignment for the swimmer during swimming and which is comfortable for the swimmer.

Still further, most of the presently-known devices are not versatile. They do not permit different users to customize the device to their particular needs and requirements. The devices cannot be customized for a particular exercise regimen. Often, the presently-known devices are difficult and cumbersome to don or doff which may exacerbate problems associated with using those devices for a disabled swimmer.

Many of the presently-known devices are not amenable to use with other accessories, such as timers and the like. This further vitiates the advantages associated with swim-in-place devices by further limiting their versatility.

Therefore, there is a need for a device that permits swimming in place but which is versatile and which is easy to don and/or doff.

PRINCIPAL OBJECTS OF THE INVENTION

It is a main object of the present invention to provide a device that can be used to improve swimming skills and obtain the benefits of lap swimming.

It is another object of the present invention to provide a device that can be used during therapy that includes swimming.

It is another object of the present invention to provide a device that can be used to improve swimming skills and obtain the benefits of lap swimming while using only a small area.

It is another object of the present invention to provide a device that can be used to improve swimming skills and obtain the benefits of lap swimming while using only a small area including a home swimming pool.

It is another object of the present invention to provide a device that can be used to improve swimming skills and obtain the benefits of lap swimming while the swimmer swims against resistance in a swim-in-place mode.

It is another object of the present invention to provide a device that can be used to improve swimming skills and obtain the benefits of lap swimming while the swimmer swims against resistance in a swim-in-place mode while retaining a proper alignment.

It is another object of the present invention to provide a device that focuses on addressing the significant forces affecting a swimmer's body during swimming and maintains proper alignment of the swimmer during use of the device.

It is another object of the present invention to provide a device that can be used to improve swimming skills and obtain the benefits of lap swimming while the swimmer swims against resistance in a swim-in-place mode while retaining a proper alignment and which will maintain proper fit, comfort, lateral and anterior/posterior alignment during a pull executed during swimming using the device.

It is another object of the present invention to provide a device that can be used to improve swimming skills while the swimmer swims against resistance in a swim-in-place mode while retaining a proper alignment and which will avoid fatigue, injury or pain during and/or after use of the device.

It is another object of the present invention to provide a device that can be used to improve swimming skills and obtain the benefits of lap swimming while the swimmer swims against resistance in a swim-in-place mode while retaining a proper alignment to permit a comfortable, safe and correctly aligned pull during swimming using the device.

It is another object of the present invention to provide a device that can be used to improve swimming skills and obtain the benefits of lap swimming while the swimmer swims against resistance in a swim-in-place mode while retaining a proper alignment and evenly distributes stress over the hips of the swimmer.

It is another object of the present invention to provide a device that can be used to improve swimming skills and obtain the benefits of lap swimming while the swimmer swims against resistance in a swim-in-place mode while retaining a proper alignment and which is adjustable.

It is another object of the present invention to provide a device that can be used to improve swimming skills and obtain the benefits of lap swimming while the swimmer swims against resistance in a swim-in-place mode while retaining a proper alignment and which is versatile.

It is another object of the present invention to provide a device that can be used to improve swimming skills and obtain the benefits of lap swimming while the swimmer swims against resistance in a swim-in-place mode while retaining a proper alignment which is also comfortable.

SUMMARY OF THE INVENTION

These, and other, objects are achieved by an exercise device for use in swimming and which comprises a belt unit adapted to be worn by a swimmer during in-place swimming and which includes a hip-encircling element which is adapted to be located adjacent to the swimmer's pelvis when worn, the hip-encircling element including an inner surface that is in contact with the swimmer when the belt unit is worn, an outer surface, a hook-and-loop material on the outer surface, and a restraining strap element which is releasably attached to the hip-encircling element when in use, the restraining strap including a proximal portion and a distal portion, and further including a hook on the distal portion; and an anchor unit adapted to be fixed to a stationary element associated with a swimming pool when the anchor element is in use, the anchor element including an anchor body having a first end, a second end, a first surface and a second surface, a first anchor ring rotatably mounted on the first surface of the anchor body adjacent to the first end of the anchor body, the first anchor ring being adapted to contact a hook on a restraining strap when in use, a second anchor ring rotatably mounted on the first surface of the anchor body adjacent to the second end of the anchor body, the second anchor ring being adapted to contact a hook on a restraining strap when in use, and a third anchor ring rotatably mounted on the second surface of the anchor body between the first end of the anchor body and the second end of the anchor body.

The exercise device embodying the present invention is oriented on a swimmer and can be adjusted, so that proper alignment is effected. The hip-encircling belt is located adjacent to the swimmer's pelvis and the restraining straps are located and can be adjusted, so the swimmers's body is maintained in proper lateral and anterior/posterior alignment whereby strain on the swimmer's back and neck is reduced. A pull that is most effective for the particular swimmer can be designed and maintained. For example, if a symmetric pull is desired, the restraining straps can be adjusted accordingly; however, if a non-symmetric pull is desired for some purpose, the restraining straps can be adjusted for this as well. Thus, the device of the present invention can be easily, quickly and accurately customized for the particular exercise and the particular needs of the swimmer to effect the most efficient and effective exercise.

As compared to presently available devices which are directed to simply holding the swimmer in place, the device embodying the present invention will not cause the swimmer to fatigue as quickly and the swimmer is not likely to experience back pain or dysfunction.

The belt is easy to don and doff and is comfortable during use. Because the belt fits over the swimmer's hips rather than around the swimmer's waist, the belt of the present invention will evenly distribute the pull through the swimmer's pelvis rather than a narrow area around the waist. This allows for full mobility of the arms during the upper stroke and the natural rotation of the back without restriction and chafing which may occur if a jacket or a narrow waist band is used.

The device embodying the present invention focuses on addressing the significant forces affecting the swimmer's body during swimming and maintains proper alignment.

The anchor bar included in the device of the present invention is easily and quickly attached to a stationary object associated with a swimming pool, such as a ladder, or the like, and will rotate and swivel so proper alignment of the swimmer is maintained. The anchor bar can rotate into a position best suited for the particular stroke being used by the swimmer, yet can be easily disconnected and connected for easy knock-down and set up of the device. Furthermore, the device is versatile and can be used with a multitude of different accessories whereby a wide variety of swimmers, swimming skills, swimming locations, swimming conditions and exercises can be accommodated by the device. Thus, a beginning swimmer can be easily accommodated as well as a skilled swimmer, or an injured person undergoing therapy. If a swimmer is hesitant to swim in a large pool or in a pool with many people, the device of the present invention can be used in a small, private, pool as well. If a swimmer requires buoyancy assistance, the device of the present invention is easily adapted to using buoyant pads for such assistance. Other accessories, such as timers, radios, and the like, are also easily used in connection with the device of the present invention thereby increasing the versatility and adaptability of the device.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in an exercise device 10 for use in swimming. Exercise device 10 can be used to practice swimming skills, to learn swimming skills, to enhance a person's cardiovascular system or a person's strength and can also be used during therapy as required.

Figure 1:
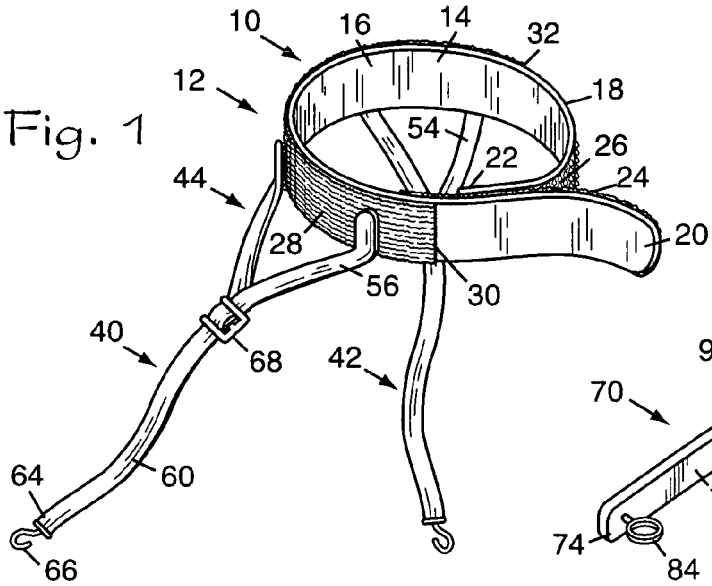
FIG. 1 is a perspective view showing a belt unit included in the swimming device embodying the present invention.
Figure 5:
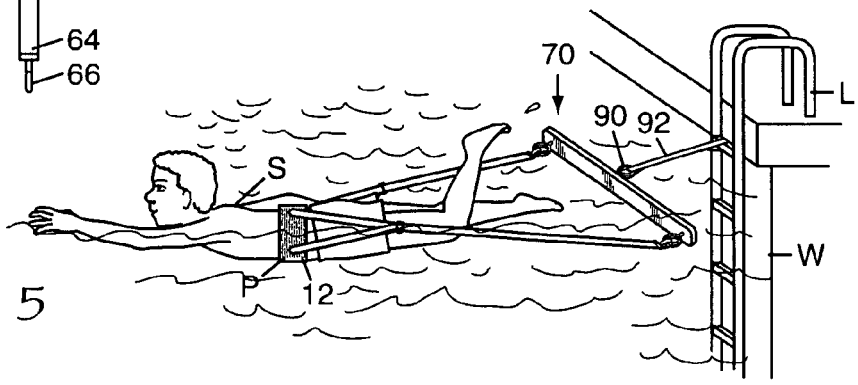
FIG. 5 illustrates a swimmer using the device embodying the present invention.

Device 10 includes a belt unit 12 which is adapted to be worn by a swimmer S as indicated in FIG. 5. Belt unit 12 includes a hip-encircling element 14 which is adapted to be located adjacent to the swimmer's pelvis P when worn (see FIG. 5). As can be seen in FIGS. 1 and 5, the hip-encircling element 14 is wider than a normal belt so forces applied to the swimmer via the hip-encircling element 14 are distributed over a wide area, thereby reducing the stress placed on the swimmer via device 10.

Hip-encircling element 14 includes an inner surface 16, an outer surface 18, a first end 20, a second end 22, a first hook-and-loop material 24 on the inner surface 16 of the hip-encircling element 14 adjacent to the first end 20 of the hip-encircling element 14, a second hook-and-loop material 26 on the outer surface 18 of the hip-encircling element 14 adjacent to the second end 22 of the hip-encircling element 14. Hook-and-loop material 26 is adapted to releasably couple to first hook-and-loop material 24 when the hip-encircling element 14 is in place on the swimmer. The size and fit of element 14 can be adjusted to meet the particular needs of the swimmer. Element 14 further includes a third hook-and-loop material 28 on the outer surface 18 of the hip-encircling element 14. Third hook-and-loop material 28 extends from a first location 30 spaced apart from the first end 20 of the hip-encircling element 14 to a second location 32 spaced apart from the second end 22 of the hip-encircling element 14.

Figure 3A:
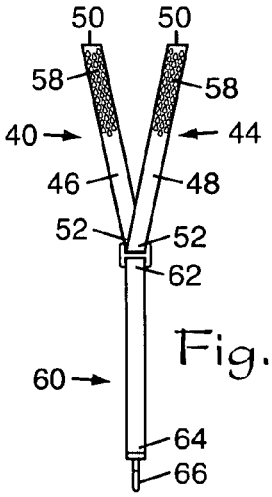
FIG. 3A shows a restraining strap included in the swimming device embodying the present invention.
Figure 3B:
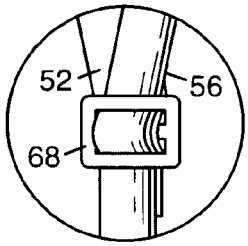
FIG. 3B shows a restraining strap with an adjustable buckle thereon.
Figure 4:
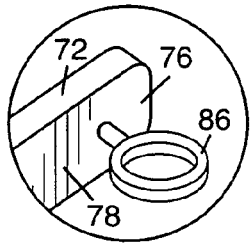
FIG. 4 shows an anchor ring included in the anchor unit.

Two Y-shaped restraining strap elements 40 and 42 are shown in FIGS. 1, 3A and 3B and are adapted to be releasably coupled to the hip-encircling element 14 when in use. The restraining strap elements 40, 42 are identical to each other and therefore only element 40 is described. Each restraining strap element 40, 42 includes a proximal portion 44 which includes two legs 46 and 48. Each leg 46, 48 includes a proximal end 50, a distal end 52, a first surface 54, and a second surface 56. Hook-and-loop material 58 is located on first surface 54 and is located adjacent to the proximal end 50 to be releasably coupled to third hook-and-loop material 28 on the hip-encircling element 14 when the restraining strap element 40, 42 is in place. The restraining strap elements 40, 42 can be moved on the hip-encircling element 14 to be in the most effective and efficient location on the swimmer to properly align the forces applied to the swimmer during exercise.

Each restraining strap 40, 42 further includes a distal portion 60 which includes a proximal end 62 and a distal end 64. A C-shaped hook 66 is fixedly connected to the distal end 64 of the distal portion 60 of each restraining strap element 40, 42.

An adjustment buckle 68 connects the proximal end 62 of the distal portion 60 of each restraining strap element 40, 42 to the distal end 52 of each leg 46, 48 of the proximal portion 44 of each restraining strap element 40, 42. The buckle 68 can also be used to further adjust the device 10 of the present invention.

Figure 2:
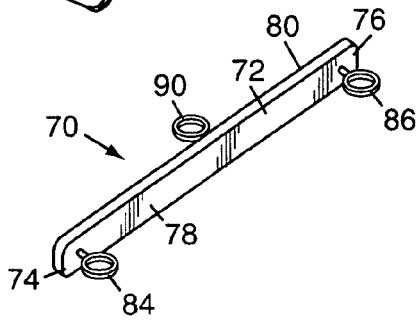
FIG. 2 is a perspective view of an anchor unit included in the swimming device embodying the present invention.

An anchor unit 70 is shown in FIGS. 2 and 5 and is adapted to be fixedly secured to a stationary element, such as a pool ladder L mounted on a pool wall W as shown in FIG. 5, associated with a swimming pool when the anchor unit 70 is in use. Anchor unit 70 includes an elongate anchor body 72, which has a first end 74, a second end 76, a first surface 78, and a second surface 80. Elongate body 72 can be formed of buoyant material.

A first anchor body anchor ring 84 is rotatably and fixedly mounted on the first surface 78 of the anchor body 72. First anchor body anchor ring 84 is located adjacent to the first end 74 of the anchor body 72 and has an arcuate shape and a diametric dimension. The first anchor body anchor ring 84 is rotatably mounted on the anchor body 72 to rotate around the diametric dimension of the first anchor body anchor ring 84. The first anchor body anchor ring 84 is adapted to be coupled to a hook 66 on an associated restraining strap element 40, 42 when the anchor unit 70 is in use as shown in FIG. 5.

A second anchor body anchor ring 86 is rotatably and fixedly mounted on the first surface 78 of the anchor body 72. The second anchor body anchor ring 86 is located adjacent to the second end 76 of the anchor body 72 and has an arcuate shape and a diametric dimension. The second anchor body anchor ring 86 is rotatably mounted on the anchor body 72 to rotate around the diametric dimension of the second anchor body anchor ring 86. The second anchor body anchor ring 86 is adapted to be coupled to a hook 66 on an associated restraining strap element 40, 42 when the anchor unit 70 is in use.

A third anchor body anchor ring 90 is rotatably and fixedly mounted on the second surface 80 of the anchor body 72. Third anchor body anchor ring 90 is located between to the first end 74 of the anchor body 72 and the second end 76 of the anchor body 72. The third anchor body anchor ring 90 has an arcuate shape and a diametric dimension and is rotatably mounted on the anchor body 72 to rotate around the diametric dimension of the third anchor body anchor ring 90. Third anchor body anchor ring 90 is adapted to be coupled to a stationary element associated with the swimming pool when the anchor unit 70 is in use. The anchor ring 90 can either be directly attached to the stationary element or can be attached using a connection element 92 as shown in Figure S.

Figure 6:
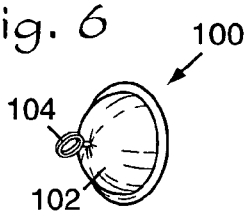
FIG. 6 is a perspective view of a suction cup that can be included in the anchor unit and which is used to attach an anchor bar to a stationary object associated with a swimming pool.
Figure 8:
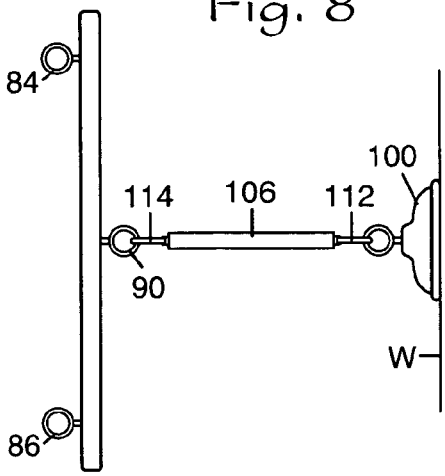
FIG. 8 illustrates a suction cup attaching an anchor bar to a stationary wall associated with a swimming pool.

If suitable, the anchor element 70 can be attached to the stationary object using other means. As shown in FIG. 6, one form of the anchor element 70 includes a suction cup element 100 which is adapted to be fixedly mounted on a wall, such as wall W, of the swimming pool when the suction cup element 100 is in use as shown in FIG. 8.

Figure 7:
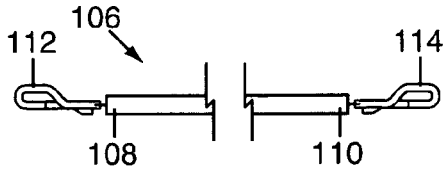
FIG. 7 is a connecting element used to connect the suction cup to the anchor bar.

Suction cup element 100 includes an arcuate outer surface 102 and a suction cup anchor ring 104 fixedly and rotatably mounted on the outer surface 102 of the suction cup element 100. A connecting element 106 is shown in FIG. 7 and has a first end 108, a second end 110, and a first coupling element 112 on the first end 108 of the connecting element 106. First coupling element 112 is adapted to be releasably coupled to the suction cup anchor ring 104 when the connecting element 106 is in use as shown in FIG. 8. The connecting element 106 further includes a second coupling element 114 on the second end 110 of connecting element 106. Second coupling element 114 is adapted to be releasably coupled to third anchor body anchor ring 90 when the connecting element 106 is in use as shown in FIG. 8. Connecting element 106 is constructed of flexible material.

Figure 10:
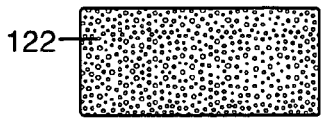
FIG. 10 shows a floatation element that can be located in the pocket shown in FIG. 9.
Figure 9:
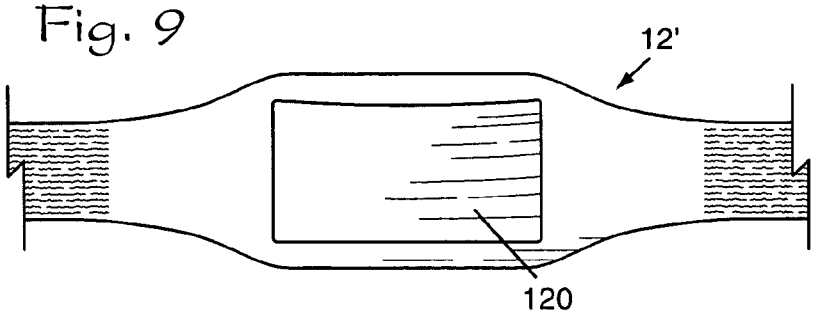
FIG. 9 shows a hip-encircling element which is included in the device embodying the present invention and which has a pocket.

Another form of the hip-encircling element is shown in FIG. 9 as element 12' and includes a pocket 120 on one surface thereof, such as the outer surface shown in FIG. 9. A floatation element 122 such as shown in FIG. 10 can be placed in the pocket of element 12'. The floatation element 122 can be used for swimmers that are not confident of their abilities.

Figure 11:
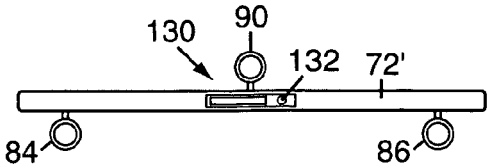
FIG. 11 shows an anchor bar having a timing mechanism thereon.

As shown in FIG. 11, a timer mechanism 130 is included on the body 72' of an alternative form of anchor element. The timer mechanism 130 can include a circuit 132 which generates and emits an audible signal after a predetermined elapsed time. This will aid in the training of some swimmers.

Figure 12:
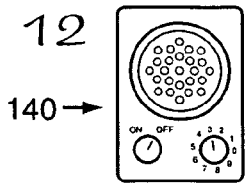
FIG. 12 shows a radio that can be mounted on the anchor bar.

As shown in FIG. 12, the device 10 of the present invention can further include a radio 140 that can be mounted on the anchor body, such as in pocket 120, if suitable.

It is noted that while swimmer S is shown in FIG. 5 executing a crawl stroke, other strokes, and combinations of strokes, can be used in association with the device of the present invention. For example, if swimmer S turns over on his or her back, the rotatable nature of the anchor rings will permit the anchor unit of the device to adapt to the new position of the swimmer.

It is understood that while certain forms of the present invention have been illustrated and described herein, it is not to be limited to the specific forms or arrangements of parts as described and shown.

What is claimed and desired to be covered by Letters Patent is:

1. An exercise device for use in swimming comprising:

a) a belt unit adapted to be worn by a swimmer and which includes (1) a hip-encircling element which is adapted to be located adjacent to the swimmer's pelvis when worn, the hip-encircling element including (A) an inner surface, (B) an outer surface, (C) a first end, (D) a second end, (E) a first hook-and-loop material on the inner surface of the hip-encircling element adjacent to the first end of the hip-encircling element, (F) a second hook-and-loop material on the outer surface of the hip-encircling element adjacent to the second end of the hip-encircling element and adapted to releasably couple to the first hook-and-loop material when the hip-encircling element is in place on the swimmer, and (G) a third hook-and-loop material on the outer surface of the hip-encircling element, the third hook-and-loop material extending from a first location spaced apart from the first end of the hip-encircling element to a second location spaced apart from the second end of the hip-encircling element, and (2) two Y-shaped restraining strap elements adapted to be releasably coupled to the hip-encircling element when in use, the restraining strap elements being identical to each other, each restraining strap element including (A) a proximal portion which includes two legs, each leg including (i) a proximal end (ii) a distal end, (iii) a first surface, (iv) a second surface, and (v) hook-and-loop material on the first surface and located adjacent to the proximal end to be releasably coupled to the third hook-and-loop material on the hip-encircling element when the restraining strap element is in place, (B) a distal portion which includes (i) a proximal end, (ii) a distal end, and (iii) a C-shaped hook fixedly connected to the distal end of the distal portion of each restraining strap element, and (C) an adjustment buckle connecting the proximal end of the distal portion of each restraining strap element to the distal end of each leg of the proximal portion of each restraining strap element; and b) an anchor unit adapted to be fixedly secured to a stationary element associated with a swimming pool when said anchor unit is in use, said anchor unit including (1) an elongate anchor body having (A) a first end, (B) a second end, (C) a first surface, (D) a second surface, and (E) the elongate body being formed of buoyant material, (2) a first anchor body anchor ring rotatably and fixedly mounted on the first surface of the anchor body, the first anchor body anchor ring being located adjacent to the first end of the anchor body and having an arcuate shape and a diametric dimension, the first anchor body anchor ring being rotatably mounted on the anchor body to rotate around the diametric dimension of the first anchor body anchor ring, the first anchor body anchor ring being adapted to be coupled to a hook on an associated restraining strap element when said anchor unit is in use, (3) a second anchor body anchor ring rotatably and fixedly mounted on the first surface of the anchor body, the second anchor body anchor ring being located adjacent to the second end of the anchor body and having an arcuate shape and a diametric dimension, the second anchor body anchor ring being rotatably mounted on the anchor body to rotate around the diametric dimension of the second anchor body anchor ring, the second anchor body anchor ring being adapted to be coupled to a hook on an associated restraining strap element when said anchor unit is in use, and (4) a third anchor body anchor ring rotatably and fixedly mounted on the second surface of the anchor body, the third anchor body anchor ring being located between to the first end of the anchor body and the second end of the anchor body, the third anchor body anchor ring having an arcuate shape and a diametric dimension, the third anchor body anchor ring being rotatably mounted on the anchor body to rotate around the diametric dimension of the third anchor body anchor ring, the third anchor body anchor ring being adapted to be coupled to a stationary element associated with the swimming pool when said anchor unit is in use.

2. The exercise device as described in claim 1 wherein the anchor unit is adapted to be fixedly secured to a swimming pool ladder.

3. The exercise device as described in claim 1 further including a pocket on the outer surface of the hip-encircling element of said belt unit.

4. The exercise device as described in claim 3 further including a floatation element in said pocket.

5. The exercise device as described in claim 1 further including a timer mechanism on the elongate anchor body of said anchor unit.

6. The exercise device as described in claim 5 wherein said timer mechanism includes a circuit which generates and emits an audible signal.

7. The exercise device as described in claim 1 further including a radio on the anchor body of said anchor unit.

8. An exercise device for use in swimming comprising:

a) a belt unit adapted to be worn by a swimmer and which includes (1) a hip-encircling element which is adapted to be located adjacent to the swimmer's pelvis when worn, the hip-encircling element including (A) an inner surface, (B) an outer surface, (C) a first end, (D) a second end, (E) a first hook-and-loop material on the inner surface of the hip-encircling element adjacent to the first end of the hip-encircling element, (F) a second hook-and-loop material on the outer surface of the hip-encircling element adjacent to the second end of the hip-encircling element and adapted to releasably couple to the first hook-and-loop material when the hip-encircling element is in place on the swimmer, and (G) a third hook-and-loop material on the outer surface of the hip-encircling element, the third hook-and-loop material extending from a first location spaced apart from the first end of the hip-encircling element to a second location spaced apart from the second end of the hip-encircling element, and (2) two Y-shaped restraining strap elements adapted to be releasably coupled to the hip-encircling element when in use, the restraining strap elements being identical to each other, each restraining strap element including (A) a proximal portion which includes two legs, each leg including (i) a proximal end (ii) a distal end, (iii) a first surface, (iv) a second surface, and (v) hook-and-loop material on the first surface and located adjacent to the proximal end to be releasably coupled to the third hook-and-loop material on the hip-encircling element when the restraining strap element is in place, (B) a distal portion which includes (i) a proximal end, (ii) a distal end, and (iii) a C-shaped hook fixedly connected to the distal end of the distal portion of each restraining strap element, and (C) an adjustment buckle connecting the proximal end of the distal portion of each restraining strap element to the distal end of each leg of the proximal portion of each restraining strap element; and b) an anchor unit which includes (1) an elongate anchor body having (A) a first end, (B) a second end, (C) a first surface, (D) a second surface, and (E) the elongate body being formed of buoyant material, (2) a first anchor body anchor ring rotatably and fixedly mounted on the first surface of the anchor body, the first anchor body anchor ring being located adjacent to the first end of the anchor body and having an arcuate shape and a diametric dimension, the first anchor body anchor ring being rotatably mounted on the anchor body to rotate around the diametric dimension of the first anchor body anchor ring, the first anchor body anchor ring being adapted to be coupled to a hook on an associated restraining strap element when said anchor unit is in use, (3) a second anchor body anchor ring rotatably and fixedly mounted on the first surface of the anchor body, the second anchor body anchor ring being located adjacent to the second end of the anchor body and having an arcuate shape and a diametric dimension, the second anchor body anchor ring being rotatably mounted on the anchor body to rotate around the diametric dimension of the second anchor body anchor ring, the second anchor body anchor ring being adapted to be coupled to a hook on an associated restraining strap element when said anchor unit is in use, (4) a third anchor body anchor ring rotatably and fixedly mounted on the second surface of the anchor body, the third anchor body anchor ring being located between to the first end of the anchor body and the second end of the anchor body, the third anchor body anchor ring having an arcuate shape and a diametric dimension, the third anchor body anchor ring being rotatably mounted on the anchor body to rotate around the diametric dimension of the third anchor body anchor ring, (5) a suction cup element adapted to be fixedly mounted on a wall of a swimming pool when the suction cup element is in use, the suction cup element including (A) an arcuate outer surface, and (B) a suction cup anchor ring fixedly and rotatably mounted on the outer surface of the suction cup element, and (C) a connecting element having (i) a first end, (ii) a second end, (iii) a first coupling element on the first end of the connecting element, the first coupling element being adapted to be releasably coupled to the suction cup anchor ring when the connecting element is in use, (iv) a second coupling element on the second end of connecting element, the second coupling element being adapted to be releasably coupled to the third anchor body anchor ring when the connecting element is in use, and (v) the connecting element being formed of flexible material.

* * * * *